US011324089B2

(12) United States Patent
Hurley et al.

(10) Patent No.: US 11,324,089 B2
(45) Date of Patent: May 3, 2022

(54) COLOR MIXING MODEL PROVISIONING FOR LIGHT-EMITTING DIODE-BASED LAMPS

(71) Applicant: Lumenetix, Inc., Scotts Valley, CA (US)

(72) Inventors: Jay Hurley, Watsonville, CA (US); Matthew D. Weaver, Aptos, CA (US)

(73) Assignee: Lumenetix, LLC, Scotts Valley, CA (US)

( * ) Notice: Subject to any disclaimer, the term of this patent is extended or adjusted under 35 U.S.C. 154(b) by 0 days.

(21) Appl. No.: 15/609,619

(22) Filed: May 31, 2017

(65) Prior Publication Data

US 2017/0265258 A1 Sep. 14, 2017

Related U.S. Application Data

(63) Continuation-in-part of application No. 15/425,467, filed on Feb. 6, 2017, now abandoned, which is a (Continued)

(51) Int. Cl.
*H05B 33/08* (2020.01)
*H05B 45/22* (2020.01)
(Continued)

(52) U.S. Cl.
CPC ..... *H05B 45/22* (2020.01); *H05B 45/20* (2020.01); *H05B 47/155* (2020.01)

(58) Field of Classification Search
CPC ..... H05B 33/0854; H05B 33/0815; H05B 33/0845; H05B 33/0863; H05B 33/0869;
(Continued)

(56) References Cited

U.S. PATENT DOCUMENTS 6,127,783 A * 10/2000 Pashley ..... H05B 45/20 315/149
6,441,558 B1 * 8/2002 Muthu ..... H05B 33/0863 315/118

(Continued)

OTHER PUBLICATIONS

Non-Final Office Action dated Feb. 17, 2016, for U.S. Appl. No. 14/631,307 by Weaver, M., et al., filed Feb. 25, 2015.

(Continued)

*Primary Examiner* — Alexander H Taningco
*Assistant Examiner* — Amy X Yang
(74) *Attorney, Agent, or Firm* — Lewis Roca Rothgerber Christie LLP

(57) ABSTRACT

Introduced here are techniques for generating color mixing models that enable a tunable lamp to mix the right amount of light from various color channels in order to properly produce colors. More specifically, a lamp controller can be configured to drive multiple light-emitting diode (LED) arrays based on corresponding color mixing models. One or more color mixing models can be provisioned into the memory of an LED array prior to usage. Storing the color mixing model in the LED array enables the lamp controller to update the color mixing model based on which LED array it is serving (i.e., the lamp controller and the LED array need not be a permanently matched set). Additionally or alternatively, the lamp controller may be configured to communicate with a network-accessible computer server system to access a historical color mixing database that includes set(s) of previously-recorded spectral properties and corresponding color mixing models.

9 Claims, 7 Drawing Sheets

Related U.S. Application Data continuation of application No. 14/631,307, filed on Feb. 25, 2015, now Pat. No. 9,565,734.

(60) Provisional application No. 62/345,349, filed on Jun. 3, 2016, provisional application No. 61/944,509, filed on Feb. 25, 2014.

(51) Int. Cl.
*H05B 47/155* (2020.01)
*H05B 45/20* (2020.01)

(58) Field of Classification Search
CPC ..... H05B 37/02; H05B 45/20; H05B 45/22; H05B 47/155
USPC ..... 315/291–294, 151
See application file for complete search history.

(56) References Cited

U.S. PATENT DOCUMENTS

| | | | | |
|---|---|---|---|---|
| 7,012,382 | B2 | 3/2006 | Cheang et al. | |
| 7,768,192 | B2 | 8/2010 | Van De Ven et al. | |
| 7,972,028 | B2 | 7/2011 | Durand et al. | |
| 8,227,979 | B2 | 7/2012 | Landry et al. | |
| 9,013,467 | B2 | 4/2015 | Sisto | |
| 9,332,612 | B1 | 5/2016 | Weaver et al. | |
| 9,565,734 | B1 | 2/2017 | Weaver | |
| 2002/0145394 | A1 | 10/2002 | Morgan et al. | |
| 2003/0057887 | A1 | 3/2003 | Dowling et al. | |
| 2006/0158881 | A1* | 7/2006 | Dowling | G03G 15/0435 362/231 |
| 2011/0187290 | A1 | 8/2011 | Krause et al. | |
| 2013/0221852 | A1* | 8/2013 | Bowers | H05B 45/22 315/131 |
| 2013/0307419 | A1* | 11/2013 | Simonian | H05B 33/0872 315/153 |
| 2015/0123564 | A1* | 5/2015 | Simonian | H05B 37/0227 315/294 |
| 2017/0303350 | A1 | 10/2017 | Weaver | |

OTHER PUBLICATIONS

Non-Final Office Action dated Oct. 23, 2017 for U.S. Appl. No. 15/425,467 of Weaver, M., filed Feb. 6, 2017.

Notice of Allowance dated Aug. 17, 2016, for U.S. Appl. No. 14/631,307 by Weaver, M., et al., filed Feb. 25, 2015.

Notice of Allowance dated Feb. 3, 2016, for U.S. Appl. No. 14/631,624 by Weaver, M., et al., filed Feb. 25, 2015.

Notice of Allowance dated Sep. 21, 2016, for U.S. Appl. No. 14/631,307 by Weaver, M., et al., filed Feb. 25, 2015.

Philips, White Paper, Optibin CKTechnology, Technology Overview, Color Consistency for Color and White Light LEDs (online), http://www.colorkinetics.com/support/whitepapers/technology_overview_optibin.pdf, pp. 1-12, 2010.

Schanda, J., et al., "Getting Color Right, Improved Visual Matching with LED Light Sources," (online) http://www.xicato.com/sites/default/files/documents/Getting_Color_Right,_PLDC_2011.pdf, Professional Lighting Design Convention, pp. 1-29, Oct. 19-22.

Csuiti, Peter et al., "Getting Colour Right: Improved Visual Matching with LED Light Sources", (online) http://www.xicato.com/sites/default/files/documents/Getting%20Color%20Right,%20PLDC%202011.pdf, PLCD 3rd Global Lighting Design Convention, pp. 19-22, 2011., Csuti, P., Schanda, J., Harbers, G., & Petluri, R. (2011). Getting color right: improved visual matching with LED light sources. In PLDC 3rd Global Lighting Design Convention (pp. 19-22).

Houser, K., et al., "Tutorial: Color Rendering and Its Applications in Lighting," Leukos The Journal of the Illuminating Engineering Society of North America, Jan. 21, 2015, https://doi.org/10.1080/15502724.2014.989802, 21 pages.

* cited by examiner

COLOR MIXING MODEL PROVISIONING FOR LIGHT-EMITTING DIODE-BASED LAMPS

CROSS-REFERENCE TO RELATED APPLICATION(S)

This application claims priority to U.S. Provisional Patent Application No. 62/345,349 titled "COLOR MIXING MODEL PROVISIONING FOR LIGHT-EMITTING DIODE (LED) BASED LAMPS" and filed on Jun. 3, 2016, which is incorporated by reference herein in its entirety.

This application is a continuation-in-part of U.S. patent application Ser. No. 15/425,467 titled "SYSTEM AND METHOD FOR RAPIDLY GENERATING COLOR MODELS FOR LED-BASED LAMPS" and filed on Feb. 6, 2017, which is a continuation of U.S. Pat. No. 9,565,734 titled "SYSTEM AND METHOD FOR RAPIDLY GENERATING COLOR MODELS FOR LED-BASED LAMPS" and filed on Feb. 25, 2015, which claims the benefit of U.S. Provisional Patent Application No. 61/944,509 titled "SYSTEM AND METHOD FOR RAPIDLY GENERATING COLOR MODELS FOR LED-BASED LAMPS" and filed on Feb. 25, 2014, each of which are incorporated by reference herein in their entirety.

RELATED FIELD

At least one embodiment of this disclosure relates generally to lighting systems, and in particular to light-emitting diode-based (LED-based) lamp systems.

BACKGROUND

One approach of producing white light is to mix the light from several colored light sources (e.g., light-emitting diodes (LEDs) or tri-phosphor florescent lamps) to create a composite spectral power distribution (SPD) that appears white. For example, by locating red, green, and blue light sources adjacent to one another and properly mixing the amount of their outputs, the resulting light can be white in appearance. With the addition of LED light sources to the palette of lighting options for lighting designers, the challenge of creating the appropriate color in a project is getting harder. Many designers have experienced this the hard way, with either disappointing initial installations or installations that fail over time, each of which require challenging fixes. Getting color right is challenging. It is thus a challenge to match color and effectively render color without distortion.

The color (or more precisely the chromaticity) of white light sources falls into the vicinity of a slightly curved line in the CIE chromaticity diagram, called the "Planckian locus." This curve represents the chromaticity of the light emitted by an ideal black body when it is heated, and is similar to the light generated by an iron rod forged by a blacksmith, or a tungsten filament in a light bulb heated by the current flowing through the filament. The chromaticities of these are generally close to the Planckian locus, and are commonly denoted by the temperature of the black body closest in chromaticity in CIE 1960 chromaticity diagram (also referred to as the "CIE 1960 color space"). This temperature is called correlated color temperature (CCT).

LEDs are typically binned by a manufacturer according to output intensity and peak wavelength. However, variations in both output intensity and peak wavelength occur between LEDs in the same bin. For a mixed system that includes multiple channels of multiple white or non-white LEDs that are driven at unique flux levels to produce a combined white light emission, the variations inherent in state-of-the-art binning of the LEDs remains too large. Although the color point of the binning tends to be relatively tight (e.g., typically 3-step or worse), the luminosity of the LEDs per unit driving current varies substantially more. As a result, the color points for a mixed LED system, which depend on relative channel luminosity as well as color point, routinely deviate. Furthermore, the mixed system channel ratios for optimal color metrics, such as color rendering index (CRI), color quality scale (CQS), and R9, may vary even more with variations in peak wavelength and phosphor emission profile. The same CRI may require a different blend of channel weights (e.g., different flux/lumens values from different color channels) if the spectra from each light source (e.g., LED) or color string (e.g., an array of multiple LEDs) are slightly different. Consequently, the output of an LED-based lamp with LEDs from the same bin can vary dramatically. Therefore, there is a need to develop a way to model each LED-based lamp accurately such that the output color and intensity of the lamp can be predictably adjusted.

Figure 1:
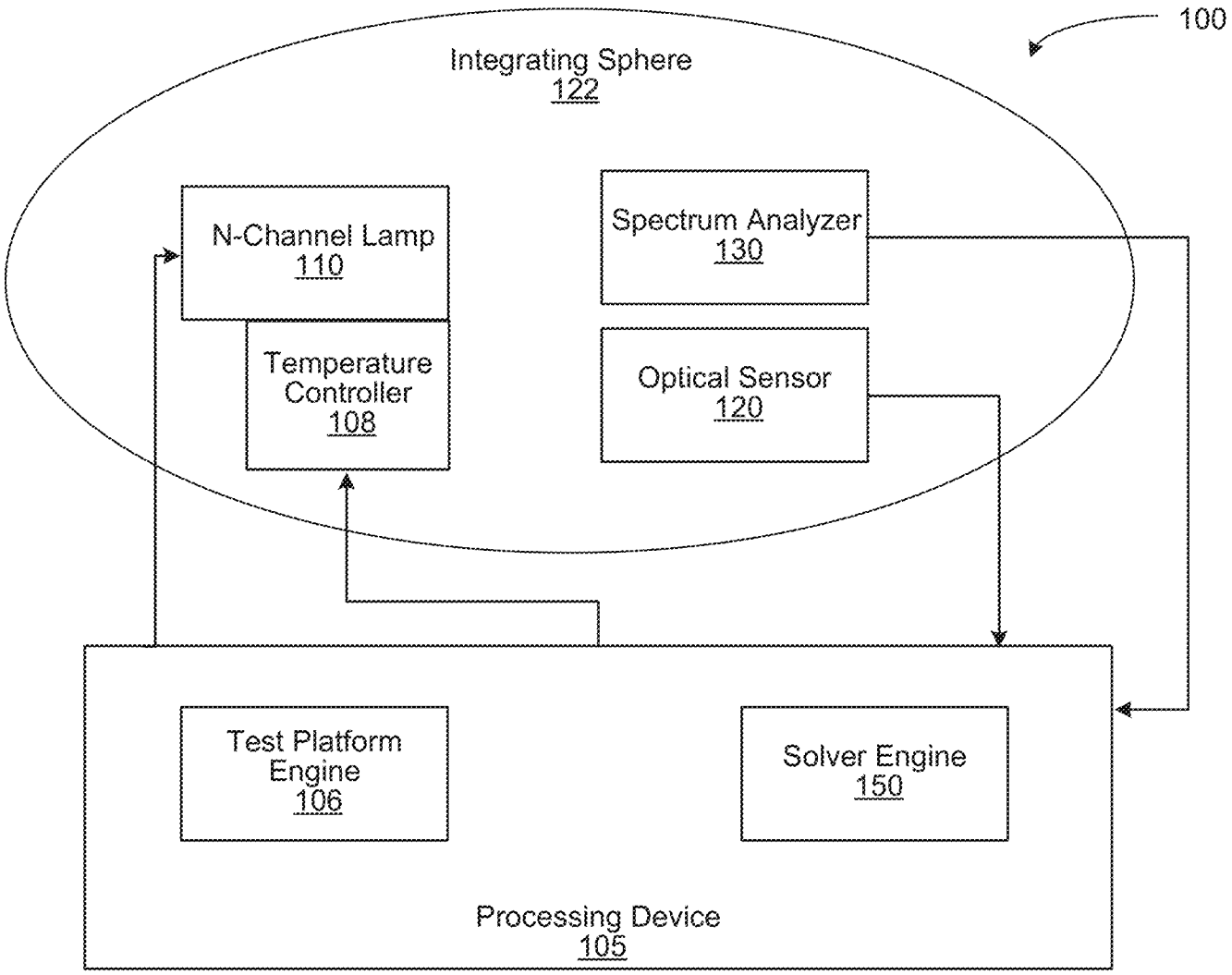
FIG. 1 shows an example of a model builder system, in accordance with various embodiments.

The figures depict various embodiments of this disclosure for the purpose of illustration only. One skilled in the art will readily recognize from the following discussion that alternative embodiments of the structures and methods illustrated herein may be employed without departing from the principles of the invention described herein.

DETAILED DESCRIPTION

Color-Mixing Models for LED-Based Lamps

A light source can be characterized by its color temperature and by its color rendering index (CRI). The color temperature of a light source is the temperature at which the color of light emitted from a heated black-body radiator is matched by the color of the light source. For a light source that does not substantially emulate a black body radiator, such as a fluorescent bulb or a light-emitting diode (LED), the correlated color temperature (CCT) of the light source is the temperature at which the color of light emitted from a heated black-body radiator is approximated by the color of the light source. The CRI of a light source is a measure of the ability of a light source to reproduce the colors of various objects faithfully in comparison with an ideal or natural light source. The CCT and CRI of LED light sources is typically difficult to tune and adjust. Further difficulty arises when trying to maintain an acceptable CRI while varying the CCT of a multi-channel LED light source.

When moving away from thermal emission for light generation, and using plasma discharge, fluorescence, and solid state emission, a system can characterize the light emission not only by CCT, but also by the distance to the Planckian locus. This distance is measured in the CIE 1960 chromaticity diagram, and is indicated by the symbol uv or Duv. Generally, the Duv is denoted by a positive number if the chromaticity is above the Planckian locus, while the Duv is denoted by a negative number if the chromaticity is below the Planckian locus. If the Duv is too positive, the light source may appear too greenish or yellowish, and if the Duv is too negative, the light source may appear to be purple or pinkish, at the same CCT.

To create uniform lighting, it is required that all the lights have the "same color," or more precisely, are visually matched. Due to manufacturing tolerances, temperature variations, and varying drive conditions, the chromaticity of light sources will vary. The sensitivity of the human eye to color differences depends on many factors, but in simplified form can be characterized by ellipses in chromaticity diagrams, where the ellipses represent standard deviations of color matching (SDCM) or noticeable differences of chromaticity (JNDC). Work in this field was first performed by David MacAdam in 1942. Accordingly, these ellipses have historically been referred to as "MacAdam ellipses." But much work has been done in this field since then, resulting in the adoption of the CIE1976 u'v' chromaticity diagram and the definition of color difference formulas denoted by ΔE, deltaE, or DE.

The overall CCT of the light generated by a multi-channel LED based lamp is sensitive to the relative amount of light produced by the different color LEDs and the spectral content of the light. Multi-channel LED lamps include multiple white or non-white LED sources that are driven at unique flux levels to produce a combined emission that appears as white light to an observer. Multi-channel LED lamps are distinguishable from single-package phosphor-converted white light LED sources. While the manufacturer of LEDs may provide a data sheet for each bin of LEDs, the LEDs in a bin still vary in their peak wavelength and in the produced light intensity (lumens per watt of input power or lumens per driving current). If even a single LED has a peak wavelength or intensity that varies from the ideal LED described in a data sheet, the resulting lamp CCT difference can be noticeable. It is very likely that more than one LED will vary from the data sheet specifications. Further, the peak wavelength and intensity of an LED varies as the driving current for the LED changes. Thus, it would be beneficial to generate a custom color mixing model for each set of LEDs in a lamp. In particular, the color mixing model can incorporate not only the brightness of the LED channel(s) with varying driving current, but also the color point (i.e., the full tristimulus state of the color channel with varying driving current as well as temperature). The color mixing model for the lamp also provides information on how hard to drive each LED string or color channel in the lamp to result in the generation of light from the lamp having a certain output power over a range of known CCTs.

For an LED-based lamp having three different color channels, the color mixing model is deterministic because there is only a single solution for a given color point or CCT. Increasing the number of different color channels in a lamp to four results in a trajectory of solutions for each color point, which is also straight-forward to model. However, when the LED-based lamp has five different color channels, there are an infinite number of solutions for every single color point, and each solution has different color qualities (e.g., CRI).

A "color mixing model" is the unique combination of drive command value or current value for each color channel to produce a specific color point (e.g. white CCT, etc.) and flux (e.g., lumen) output, given the base temperature, associated color channel outputs, possible "aging"/derating factors, etc. This is a complex interdependent value given that the local "junction" operating temperature of each channel depends on its own operating state as well as the operating state(s) of its neighbor(s) and the "base" temperature of the lamp. An inverse solver takes all these thermal effects into account when resolving a flux ratio.

Empirical Method of Computing Color Quality

Under an empirical method of color matching, an empirical solver system can obtain color quality metrics, such as Color Rendering Index (CRI), Color Quality Scale (CQS), memory Color Rendering Index (mCRI), gamut area, and R9, for a particular lamp by performing the following steps. The gamut area represents a complete subset of colors that can be accurately represented in a given circumstance, such as within a given color space and/or by a certain output device (e.g., the lamp).

"Gamut" is the set of possible colors that a set of luminous sources can produce. A single source can only produce a singular color point. Two differentiated color sources can produce a set of colors/color gamut in the color space that is represented by a line between the two respective source color points. By varying the relative output of the two channels the combined color can "walk the line" between the two source colors.

Three differentiated color sources produce a "triangular" color gamut—the corners are defined by the source color points and the set of possible colors are defined by the entire internal area of the triangle. More than three colors will form a space defined by a polygon that minimally encloses all the source color points (e.g., it may be a square, a pentagon, a triangle, etc.). Some source colors may have color points that reside within the gamut area (e.g., a "white" LED color point within an RGB triangle). Colors outside the polygon area cannot be produced. For a 3-channel source system, one and only one unique ratio defines each color point in the gamut. In other words, the color points can be produced, but each color point has only one fixed pre-determined spectrum associated with it. With four or more differentiated source channels, an infinite combination of spectra may be produced to represent a single color point. The range of the spectral variation associated with each color point depends on the unique spectra of the sources. This gives rise to the ability to "tune" the spectrum of a single color point, such as the "white" color point of a 2700 Kelvin "blackbody."

The empirical solver system obtains a test spectrum from the lamp that defines the CCT. In other words, a sensor system can measure the spectrum of the lamp, and a model builder can calculate the CCT of the measured spectrum from the measured spectrum. With the CCT defined, the model builder can generate a reference lamp spectrum for that unique CCT. For example, the reference lamp spectrum can be in reference to a Planckian blackbody emission spectrum or a computed daylight illuminant spectrum. The model builder can multiply the measured lamp spectrum (e.g., the "test lamp spectrum") and the reference lamp spectrum against an array of standard color cards that span a broad gamut area of color space, typically 8 to 15 color cards. Color cards are reference color samples in one of the standardized color space (e.g., CIE 1964 color space). Then, the model builder can quantitatively compare the difference in luminosity and color point of the light reflecting off the color cards for each spectrum to obtain one or more color qualities for the test lamp.

The empirical method for computing color quality for a given lamp is computationally intensive. The first step involves the sensor system measuring the test spectra for the lamp. The spectral intensity of each individual color channel of N color channels of the lamp is measured over a range of power levels, and then the model builder sums the spectra from each of the color channels to compute the test spectra as an aggregate. In some cases, because the obtainable color space with five or more channels can have multiple maxima and minima for various color metric measurements, such as CRI and R9 (e.g., a color rendering value used to quantify a lamp's ability to produce vivid red), a resolution of about 400 steps between the minimum driving current and the maximum driving current for each channel are used to obtain sufficient data to determine combinations of driven LEDs to generate particular CCT output values. In those cases, for a five color channel lamp, the number of possible spectral combinations is $400^5$ or 10.24 trillion, and each of these spectral combinations has to be analyzed to build an accurate color mixing model. Because each individual spectrum includes spectral data taken at a one-nanometer spacing across the visible spectrum, spanning up to 830 nm, the computation involved to compute a possible test spectra (e.g., different test spectrum produced by the lamp based on different steps in different color channels) is highly intensive.

The next step in the empirical method of color mixing model generation is to perform a dot product of each of the possible spectral combinations against mathematical functions representing the response of the human eye to obtain the X, Y, and Z tristimulus values, where Y is a measure of luminance, Z is a measure of blue stimulation of the human eye, and X is a linear combination of human eye cone cell response curves.

After the tristimulus values are obtained, an equivalent CCT for each of the 10.24 trillion spectra is determined. One method for determining the equivalent CCT is to perform a McCamy cubic approximation, as provided by: $CCT(x,y)=-449n^3+3525n^2-6823.3n+5520.33$, where n is the inverse slope line. However, chromatic adaptation is also needed to resolve persistent color point differences between the test spectrum and the reference spectrum. With the empirical technique, the CCT is unknown until the test spectra for each of the individual color channels are combined, and the CCT must be calculated for each possible combination of power level of each color channel.

Next, a reference spectrum is generated for each unique CCT obtained in the previous step. For CCT values less than 5000K, a blackbody can be used for the reference source, and the Planckian radiation distribution is calculated directly for the given CCT. For all other CCT values, a standard daylight illuminant is used that is based on a daylight spectrum.

For each color point to be calculated, both the test spectrum and the reference spectrum are multiplied against each of the standard color card reflectivities, where the color card reflectivities are a set of reflection coefficients over the visible spectrum, and the reflection coefficient is one for a perfect reflection and less than one otherwise. After multiplying by the reflectivity coefficient of the test color card for each wavelength, the result is a reflected spectrum that is multiplied by eye response curves (typically, for bright illumination around 50-1000 lux levels) for a 2° standard observer for XYZ tristimulus values associated with the reflected light for each card. While other standard observer profiles may be used, many are very similar in principle with only slight variations. Three full spectrum products are performed for each color card. Thus, the product is obtained wavelength by wavelength, and then the products for each wavelength is summed for both the test spectrum and the reference spectrum to obtain a point in a three-dimensional (3D) color space comprising luminosity (brightness) and a two-dimensional (2D) color coordinate for the test spectrum and another point for the reference spectrum.

The uv space coordinates are calculated for XYZ tristimulus values for all color card reflections, and the color points are then verified as to whether they are close enough to be valid (i.e., whether Auv space is less than 0.0054). Then the UVW* coordinates are calculated from uv and Y.

The 2D/3D color point obtained for the test spectrum and the 2D/3D color point obtained for the reference spectrum do not necessarily coincide. The larger the difference between these two color points, the more color distortion is perceived by the human eye. So although the test lamp and the reference lamp may have the same color temperature and color coordinate, they can have different spectra.

The CCT color points of the test lamp may be above or below the blackbody Planckian locus or the daylight spectrum locus in color space. To minimize the influence of the color delta between the actual color point and the desired locus of the reference spectrum, a chromatic adaptation calculation needs to be performed on all color points prior to evaluating the color difference and subsequent R values (also referred to as the "special CRT" or "particular CRT").

Then the Euclidean distance (ΔE) between the chromatically-adapted color points in UVW* space between the test card and the reference lamp reflections is calculated for each color card reflectivity. Both test spectral source and the reference lamp source are normalized, for example, to 100 lumens.

Next, the R value for each of the color cards is calculated based on the respective ΔE values: $R_i=100-4.6\Delta E_i$. In particular, R9 is a useful indicator for how well the light shows deep saturated shades of red. And finally, CRT is calculated as the average of the R values for color cards 1 through 8.

Thus, with the empirical method of calculating color quality for a multi-channel lamp, there are a large number of data points to be manipulated to obtain a color mixing model for the lamp. Described below is a greatly improved algorithm for obtaining a color mixing model with many fewer computational steps.

Generating Color Mixing Models Rapidly with an Inverse Solver Algorithm

FIG. 1 shows an example of a model builder system 100, in accordance with various embodiments. The model builder system 100 can include an integrating sphere 122 coupled together with an optical sensor 120. The optical sensor 120 may be the same sensor system as with the empirical method. The optical sensor 120 can sense the output from an N-channel lamp 110 (e.g., an LED-based lamp) that is controlled by a processing device 105 (e.g., the computing device 500 of FIG. 5). The processing device 105 can implement a test platform engine 106. The test platform engine 106 can turn on each LED or LED string (e.g., multiple LEDs of the same color) individually and control the driving current from a minimum amount of current needed for stable operation to the maximum amount of current to be used for that color channel. In some embodiments, the test platform engine 106 controls the operating temperature of an array of multiple LEDs utilizing a temperature controller 108. For example, the temperature controller 108 can be a closed-loop, Peltier device for heating and/or cooling the base of the LED array (e.g., although not the individual LEDs in the array) to a specified operating temperature.

Under the empirical method for obtaining color quality data, the number of steps between the minimum and maximum driven current should be about 400. However, the inverse solver algorithm introduced here allows far fewer than 400 steps to be used per channel. It is only necessary to take a sufficient number of spectral measurements to capture the curvature of the tristimulus values (e.g., "XYZ") profiles with command inputs to the LED driver in the N-channel lamp 110. In some instances, anywhere from three to ten sample spectral operating states spanning the minimum to maximum are evaluated, and the test platform engine 106 can fit spline curves to the sample spectral operating states. Key operating points to sample include where any discontinuity in curvature occurs. Such discontinuities typically arise from the driver electronics, for example, a change from continuous current to variable pulse width at fixed minimum current at lower output levels. The fitted spline curves are then divided into a higher number of test points, typically 400 or higher. The driving current steps can be linear, non-linear, or even arbitrary. For example, more closely spaced steps can be taken over particular current ranges to capture possible or actual points of inflection inherent in the flux/command curve. These inflections typically occur at a point that may transition between pulse width modulation mode and continuous output/variable current mode driving the LEDs. For each step, the output light from the N-channel lamp 110 is measured by an optical sensor 120 within an integrating sphere 122. A spectrum analyzer 130 can receive the output from the optical sensor 120 and determine a magnitude of the intensity in radiometric units (watts/nm). The spectrum analyzer 130 or the processing device 105 can also convert the output of the optical sensor 120 to lumens and color point as a function of frequency (e.g., an intensity spectrum). In turn, the spectrum analyzer 130 can provide spectral data for each individual color channel of the N-channel lamp 110 over a range of driving currents.

The model builder system 100 can further include a solver engine 150. The solver engine 150 may be implemented by the same processing device as the test platform engine 106 (i.e., processing device 105) or another processing device. The solver engine 150 can implement the processes (e.g., the inverse solver algorithm) as described in U.S. patent application Ser. No. 15/425,467 titled "SYSTEM AND METHOD FOR RAPIDLY GENERATING COLOR MODELS FOR LED-BASED LAMPS," which is incorporated by reference herein in its entirety.

A single color point may be produced by multiple different spectra. For example, white sunlight consists of a broad spectrum of light roughly resembling a continuous Planckian "black body" spectral energy distribution (minus some absorption and scattering bands). The same white point may be produced by blending three LED sources, such as red, green, blue, that appear the same when reflecting off a white paper. However, when reflecting off colored objects, the resulting color under one spectrum versus the other most likely will not be same and in some cases dramatically different.

An inverse solver can restrict the scope of its solver space by specifying "floating" and "non-floating" variables. At the physical lamp level, all the color channels are "adjustable output" luminous devices each with unique spectral properties (e.g. red, amber, lime, cyan, royal blue, etc.). For an inverse solution to a single color point in the color space, there must be at least three differentiated color channels that can be adjusted. One of the three channels is set to a "fixed" positive value (light source, not sink). Given a target color point, there is only one combination (and, in some instances, no combinations) of those three color channels that will produce that color point.

With the target color specified and one of the three sources "fixed" (or "non-floating") at a known flux level, the other two channels are considered "unknowns" or "floating" and can solved by inverse matrix math. With greater than three source channels (quantity of "N" sources in total), a predefined or "fixed" ratio of N−2 of the sources is established with its characteristic color point and flux, thus creating a composite "fixed" source. This pre-defined ratio may be varied by discretely indexing through their full range of possible values and combined. Given a "fixed" ratio of the N−2 source channels, the flux level of the remaining two "floating" channels are then solved by inverse matrix math.

A unique combined spectrum is composed of the prespecified "fixed" N−2 channel flux levels and the two "floating" channel levels. The color qualities of this composite spectrum are investigated, but not by direct means. If direct means were used, the solution process would be orders of magnitude slower and not viable for many uses, most importantly lamp-to-lamp production at high-speed to overcome inherent variability in color point and flux across temperature and output of source LEDs from lamp to lamp.

Even if a particular LED source is perfectly identical from lamp-to-lamp, if even the $V_f$, thermal conductivity, void percentage of the solder connection, copper layer, or dielectric varies, then the junction temperature for a given light output will be different for the same lamp thermal base temperature and the "identical" LEDs will be significantly different in their operating points and thermal responses. In such instances, the "identical" LEDs will in fact not match significantly. These variations and others have been well observed and are the basis for the necessity of lamp-to-lamp solving of a color model and the need for a rapid solution tool in order to enable the existence of high-fidelity, high-dynamic range light sources.

A reference spectrum can be arbitrary to the inverse solver, with "white" optimizations typically employing black body or daylight or blend of. Any "white" spectrum profile can be the optimizing "target" the inverse solver attempts to best mimic with the light sources available. "Off-locus" (i.e., non-zero Duv) solutions can fall under this as well (e.g., essentially a near-white reference spectrum with slight distortions introduce that cause it to shift to greenish or purplish at same CCT). In some embodiments, the optimization is not limited to a single point in the color space. A "curve" or 2D region in the color space (e.g., essentially a finite set of single points) can be compared for the same optimization task. This arises across CCT variation for the "white" locus, as well as for optimization for a fixed CCT (e.g., roughly orthogonal to the white locus, slightly above or below it). This readily arises in lower channel count systems (e.g., a 3-color white system) and picking a non-zero Duv that maximizes all parameters of interest.

Figure 2A:
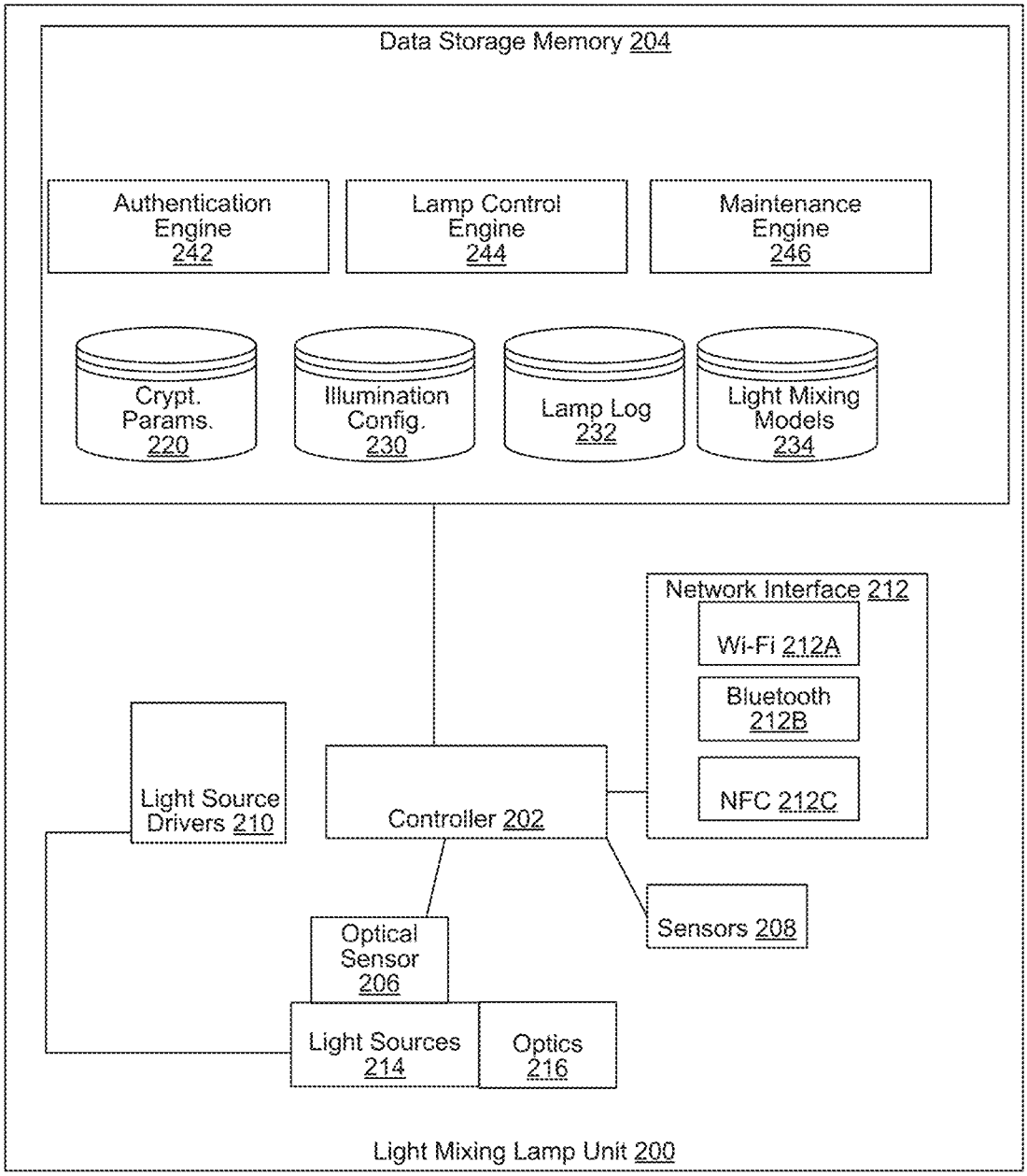
FIG. 2A is a block diagram of a light mixing lamp unit, in accordance with various embodiments.

FIG. 2A is a block diagram of a light mixing lamp unit 200, in accordance with various embodiments. The light mixing lamp unit 200 may be included in the N-channel lamp 110 of FIG. 1. The light mixing lamp unit 200 can include a controller 202, a data storage memory 204, an optical sensor system 206 (e.g., a camera, a light sensor, a light filter, a tristimulus sensor, or any combination thereof), one or more sensors 208 (e.g., temperature sensors, electric voltage sensors, electric current sensors, ambient light sensors, or any combination thereof), one or more light source drivers 210, one or more network interface components (e.g., a Wi-Fi component 212A, a Bluetooth component 212B, a Near Field Communication (NFC) component 212C, or any combination thereof, which are collectively referred to as the "network interface components 212"), one or more light sources 214, one or more optics components 216, or any combination thereof. Some of these components can be considered an internal "lamp control unit" of the light mixing lamp unit 200. That is, the lamp control unit can be part of the light mixing lamp unit 200.

The light sources 214 can include LED arrays composed of solid state LEDs or organic LEDs. In some embodiments, the light sources 214 include different color channels, where each color channel corresponds to one or more LEDs of the same color. The optics components 216 can mix, direct, filter, and/or alter individual or combined light outputs produced from the light sources 214. In some embodiments, the optics components 216 include an adjustable optical component, whose effects on its inputting light are configurable by the controller 202 or by an external source. In some embodiments, the optics components 216 include only passive optics and/or static optics.

The data storage memory 204 can be protected via one or more hardware or software cryptographic mechanisms. For example, the data storage memory 204 can have a secure store storing the cryptographic parameters 220 associated with the light mixing lamp unit 200 for preventing unauthorized modification or replacement of functional components of the light mixing lamp unit 200 and for preventing unauthorized modification or replacement of parameters of the functional components. The data storage memory 204 can also store an illumination configuration profile 230 for the light mixing lamp unit 200. The data storage memory 204 can store a lamp log 232 for the light mixing lamp unit 200.

In one example, the illumination configuration profile 230 can include a spectral representation of an expected illumination produced by the light mixing lamp unit 200 (and, more specifically, the light sources 214 or the optics components 216). For instance, the illumination configuration profile 230 may include a reduced version of the full spectral power distribution (SPD). In another example, the illumination configuration profile 230 can include one or more color attributes and/or color metrics used to characterize visual illumination (e.g., the CCT, hue, brightness/intensity, saturation, or any combination thereof). In another example, the illumination configuration profile 230 can include one or more performance criteria (e.g., driving attribute limitations) that affect the production of visual illumination, such as power consumption, thermal profile, efficiency, efficacy, or any combination thereof.

The performance criteria can include various performance criteria families. For example, in the "flux" family, performance criteria can include matching the output lumens to a photopic response curve. The lumens criteria can reference the Scotopic lumens, Melanopic lumens, and/or other direct eye pigment sensitivity curves aside from melanopic, such as rhodopic (e.g., rod vision, which plays a role in how dim-lighting appears, mesopic lighting, and scotopic lighting) or the "RGB" of cone vision (e.g., erythropic, chloropic, cyanopic). These can be minimized/maximized or set to a target range given the flexible "brute-force" approach of the inverse solver. For example, a "warm" CCT may be produced that minimized melanopic flux for circadian, or a higher CCT may be produced that maximizes melanopic flux (e.g., over what a "natural" daylight or blackbody spectrum of same CCT would exhibit). Plant flux can also be optimized as part of the performance criteria (e.g., photosynthetic action spectrum or "PAR" flux).

As another example, in the efficacy family, performance criteria can include optimization of wattage (e.g., electrical, thermal, and/or radiometric), lumens per watt, and/or other factors involving wattage or lumens per watt. For example, PAR watts/electrical watts could be optimized. As yet another example, in the "Color Card" family, level and test/ref error difference can be optimized as part of the performance criteria. For example, the R9 (red) color card, green color card, purple color card, or some other reflectivity color card can be used to maximize a color to make the color of a certain material "pop."

The illumination configuration profile 230 can include driving parameters when producing visual illumination, such as driving current, driving signal pattern, driving voltage, operational temperature (e.g., if controllable), or any combination thereof, of the light sources 214. In some embodiments, the data storage memory 204 stores multiple instances of the illumination configuration profile 230, while only a subset of the instances is actively used to configure the light mixing lamp unit 200. In some embodiments, the illumination configuration profile 230 is not indicated as the driving parameters because the light sources 214 and the optics components 216 may degrade and/or because depending on ambient temperature or operating temperature, the same driving parameters may not produce the same expected illumination.

In several embodiments, the data storage memory 204 includes one or more light mixing models 234. In the examples where that the illumination configuration profile 230 is not indicated as the driving parameters, then the controller 202 has to determine, according to the light mixing models 234, how to drive the light sources 214 to in order to produce the intended illumination profile (e.g., at an operating point in the color space under a set of performance criteria, such as color quality and/or power efficiency/efficacy). In some embodiments, the illumination configuration profile 230 includes some or all of the light mixing models 234. In these examples, the light mixing models 234 can provide a way for the controller 202 to determine how to drive the light sources 214.

The lamp log 232 may include communication activities occurring through the network interface components 212. In one example, the lamp log 232 includes a historic log of configuration changes to the illumination configuration profile 230. In one example, the lamp log 232 includes sensor data collected from the sensors 208. In one example, the lamp log 232 includes health/deterioration data that, for example, specifies optical changes, such as functional defects, in the light sources 214 or the optics components 216. Some portions of the lamp log 232 may only be accessible to an authenticated agent of a back-end server system that can produce a cryptographic signature recognizable by the controller 202. Additionally or alternatively, some portions of the lamp log 232 can be associated with an owner/user. That association can be stored in the back-end server system, a lamp commissioning application executing on a computing device (e.g., a mobile phone), and/or the data storage memory 204. The controller 202 can implement an authentication engine 242 to authenticate the owner/user. In those embodiments, those portions of the lamp log 232 may be accessible only to the authenticated owner/user associated with the secured portions.

In several embodiments, the data storage memory 204 stores executable instructions. The executable instructions can configure the controller 202 to implement one or more engines or modules, including, for example, the authentication engine 242, a lamp control engine 244, and/or a maintenance engine 246. The authentication engine 242 restricts access to change executable instructions, data, or parameters of the light mixing lamp unit 200 and/or access to extract data from the light mixing lamp unit 200. The lamp control engine 244 can communicate with outside sources (e.g., a mobile device) via the network interface components 212 to accept commands therefrom. Based on a command, the lamp control engine 244 can change an operating state of the light mixing lamp unit 200, for example, to produce a different illumination. The lamp control engine 244 can determine how to drive the light sources 214 based on at least one of the light mixing models 234, one or more sensor feeds from at least a subset of the optical sensor system 206 and/or the sensors 208, the illumination configuration profile 230, one or more commissionable lighting parameters, one or more operational lighting parameters, or any combination thereof. The maintenance engine 246 can monitor sensor feeds from the optical sensor system 206 and/or the sensors 208 to determine whether or not a recalculation of at least one of the driving parameters and/or the light mixing models 234 may be necessary. The maintenance engine 246 can be executed periodically according to a schedule. The maintenance engine 246 can be triggered by an external command or by the light mixing lamp unit 200 being turned on. The maintenance engine 246 can also monitor the sensor feeds to update the lamp log 232.

In some embodiments, the optical sensor system 206 can be utilized to provide feedback when adjusting the illumination according to the illumination configuration profile 230. Additionally or alternatively, the optical sensor system 206 can be utilized to generate health data for the light sources 214, for example, to determine whether or not there is decalibration.

In some embodiments, the light mixing lamp unit 200 may be hardcoded with an identifier and/or a cryptographic parameter from the manufacturer. The identifier and/or the cryptographic parameter enables agents of the manufacturer (e.g., a back-end server or a lamp commissioning application) to uniquely identify the lamp unit and extract data associated with the lamp unit only available to the manufacturer. The identifier and/or the cryptographic parameter can also enable agents of the manufacturer to verify that the lamp unit is authentic and complies with known security protocols/policies.

Figure 2B:
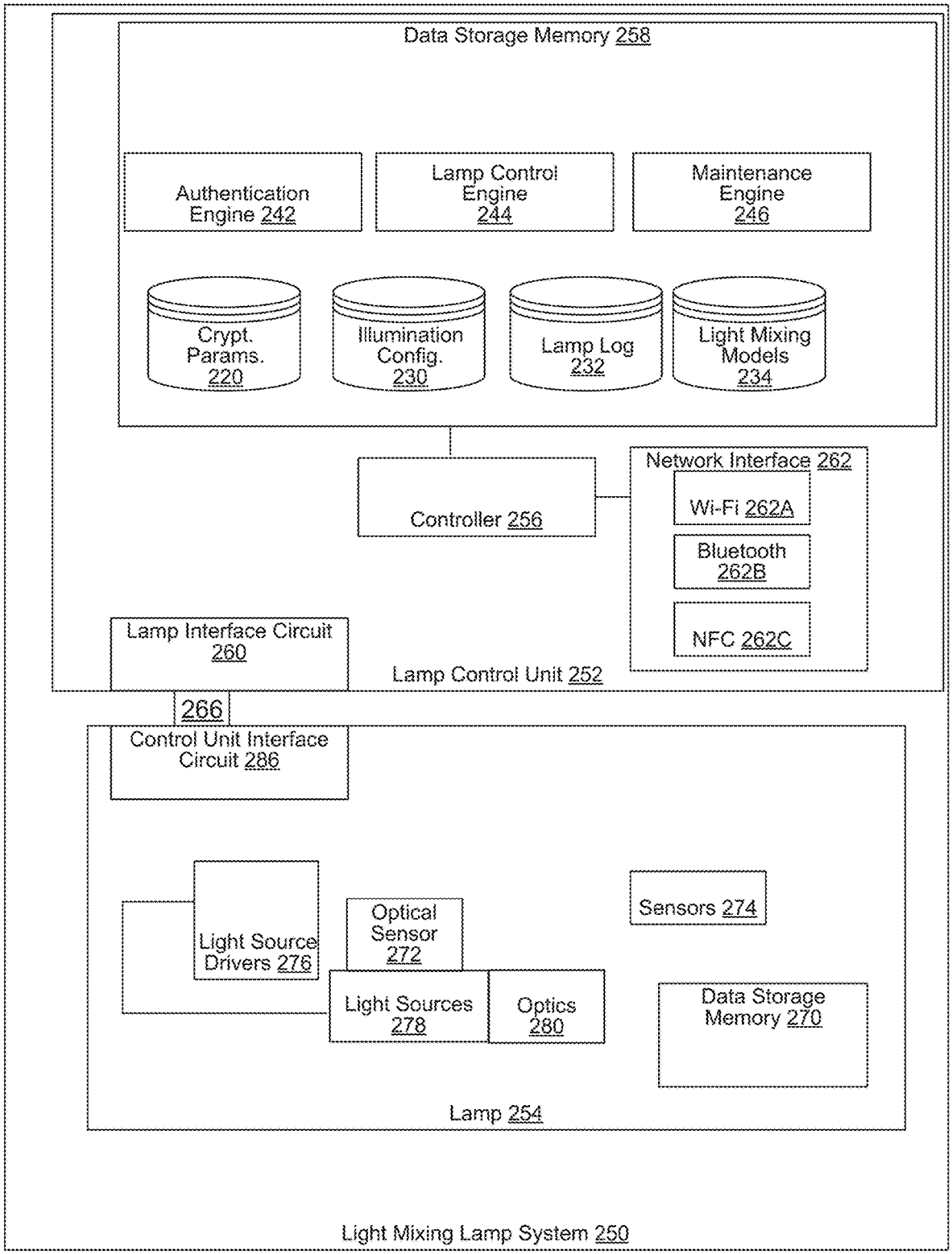
FIG. 2B is a block diagram of a light mixing lamp system, in accordance with various embodiments.

FIG. 2B is a block diagram of a light mixing lamp system 250, in accordance with various embodiments. The light mixing lamp system 250 can include a lamp control unit 252 that is coupled to at least one lamp 254. The lamp control unit 252 can include a controller 256, a data storage memory 258, a lamp interface circuit 260, one or more network interface components 262, or any combination thereof. The lamp control unit 252 can be coupled to the lamp 254 via wireless or wired communication channel, such as a cable 266. The lamp 254 can include a data storage memory 270, an optical sensor system 272, one or more sensors 274, one or more light source drivers 276 coupled to the lamp interface circuit 260 (e.g., via the cable 266), one or more light sources 278, one or more optics components 280, or any combination thereof. In these embodiments, the controller 256 can serve the functionalities of the controller 202; the data storage memory 258 and/or the data storage memory 270 can serve the functionalities of the data storage memory 204; and the network interface components 262 can serve the functionalities of the network interface components 212. In these embodiments, the optical sensor system 272, the sensors 274, the light sources 278, and the optics components 280 can serve the functionalities of the optical sensor system 206, the sensors 208, the light sources 214, and the optics components 216, respectively. The lamp control unit 252 can communicate with the lamp 254 via the lamp interface circuit 260. The lamp 254 can communicate with the lamp control unit 252 via a control unit interface circuit 286.

The controller 256 can access one or more commissioned parameters and a color mixing model stored in the data storage memory 270. Based on the color mixing model and the commissioned parameters, the controller 256 can determine the driving signals to send via the lamp interface circuit 260. In some embodiments, the driving signals include digital or analog indications of the flux ratios of the color channels of the light sources 278. In these embodiments, the light source drivers 276 can interpret the driving signals and provide (e.g., by drawing power from a power source coupled to the lamp 254) electrical currents to the color channels of the light sources 278 according to the indicated flux ratios. In some embodiments, the driving signals are power signals configured with the correct flux ratios according to the controller 256.

Color Mixing Model Provisioning

An LED-based lamp system (e.g., the light mixing lamp unit 200 of FIG. 2A or the light mixing lamp system 250 of FIG. 2B) can include one or more of LED arrays (e.g., light sources 214 and/or light sources 278). In some embodiments each of the LED arrays includes multiple color strings, while in other embodiments each LED array corresponds to a single color string. Each color string of the multiple color strings has one or more LEDs of substantially the same color. However, the multiple color strings may include different colors. A lamp controller (e.g., controller 202 and/or lamp control unit 252) of the LED-based lamp system can be configured by a color mixing model (e.g., one of the light mixing models 234) to drive the multiple color strings of the LED arrays to generate a composite light output at specific operating points in the color space.

The lamp controller can receive commands or provisioning parameters to produce light at a particular operating point in the color space. The particular operating point can be specified as a CCT, a tristimulus value, an RGB value, a color space coordinate, or any combination thereof. The color mixing model can identify operating parameters to drive the multiple color strings of the plurality of LED arrays in order to produce the intended operating point in the color space.

In several embodiments, a data storage memory system (e.g., data storage memory 204, data storage memory 258, and/or data storage memory 270) of the LED-based lamp system can store multiple color mixing models corresponding to the plurality of LED arrays. For example, the data storage memory system can include one or more electrically erasable programmable read-only memories (EEPROMs).

In some embodiments, the lamp controller is configured to drive multiple LED arrays utilizing multiple individual color mixing models corresponding to the multiple LED arrays. For example, the data storage memory system can include a plurality of memory devices in each of the plurality of LED arrays. In those embodiments, each memory device stores a color mixing model for the corresponding LED array.

The lamp controller may be configured to update a color mixing model corresponding to an LED array based on an optical sensor recording a light output of the LED array. In some embodiments, the lamp controller is configured to generate a combined color mixing model based on the multiple individual color mixing models corresponding to the LED arrays. For example, the combined color mixing model is generated as a weighted average of the multiple individual color mixing models.

One or more color mixing models (e.g., corresponding to one or more LED arrays) can be provisioned into the memory of the LED-based lamp system prior to usage. An inverse solver can compute an accurate color mixing model to account for variation in LED bins of an LED array as captured at the point of production. This process can be based on recorded spectral properties (e.g., the SPD of the LED array and/or the SPDs of individual color channels in the LED array) by testing the LED bins in a spectral analyzer. The information for this color mixing modeling can be stored in permanent memory in the lamp controller and/or on the LED array itself. Storing the color mixing model in the LED array enables the lamp controller to update the color mixing model according to which LED array it is serving rather than keeping the lamp controller and the LED array as a permanently matched set. Further, a lamp controller may be attached to multiple LED arrays with multiple stored color mixing models. In this case, the lamp controller can combine the data from each LED array to devise the best overall color mixing model. For example, the lamp controller may average operating parameters dictated by the color mixing models across the LED arrays for a given intended operating point in the color space.

In some embodiments, the lamp controller is configured to communicate with a network-accessible computer server system to access a historical color mixing database. The historical color mixing database can include multiple sets of previously-recorded spectral properties and corresponding color mixing models that are accessible via a plurality of identification codes of LED arrays. In some embodiments, the lamp controller is configured to retrieve an identification code (e.g., serial number, barcode, QR code, etc.) associated with at least one of the LED arrays, and then query the historical color mixing database for a color mixing model corresponding to the at least one of the LED arrays in the LED-based lamp system. The identification code may be affixed to an outer surface of the LED array or maintained in a data storage memory of the LED array. In some embodiments, the historical color mixing database is keyed to respective identification codes, spectral property sets, or both, of the respective LED arrays. In some embodiments, upon attaching the lamp controller to an LED array, the lamp controller can query the network accessible computer server system utilizing the identification code and retrieve a color mixing model therefrom in response.

In several embodiments, the LED based lamp system includes one or more photodiodes in and/or facing the LED arrays. The photodiodes can be configured to provide feedback to the lamp controller for each color channel of the LED arrays. In some embodiments, the feedback includes a light intensity of a color channel. In some embodiments, the feedback includes multiple light intensities corresponding to different bandwidth photodiodes (e.g., photodiodes that detect light at different spectral bands and/or different spectral peaks) of a color channel. In those embodiments, the lamp controller is configured to detect color shift in the color channel.

In some embodiments there is a single photodiode for each LED array, while in other embodiments the LED-based lamp system includes multiple photodiodes for each LED array. Each photodiode may correspond to a single color channel of an LED array or LED-based lamp system. Alternatively, each photodiode can be used for some or all of the color channels. In these embodiments, a photodiode can measure a single color channel by turning the other color channels off when measuring.

The data storage memory system can be configured to store a reference color mixing model for a reference LED array. The reference color mixing model is generated based on characterized spectral properties of a representative LED array that is not actually the LED array in the LED-based lamp system. In some embodiments, the lamp controller is configured to adjust the reference color mixing model based on the feedback from the photodiodes. In some embodiments, the data storage memory system is configured to store a plurality of reference color mixing models corresponding to a plurality of reference LED arrays. In those embodiments, the lamp controller is configured to select at least one of the reference color mixing models based on the feedback from the photodiodes and to utilize the selected reference color mixing model to drive the LED arrays. The different types (e.g., different color channel, different photodiodes, or any combination thereof) of feedback may correspond to different types of reference color mixing models.

Photodiode feedback can be used to adjust color mixing models to account for the aging of components of the LED-based lamp system over time. The photodiode feedback advantageously eliminates the need to characterize every LED array through production/manufacturing.

Physical and functional components (e.g., devices, engines, modules, data repositories, etc.) associated with the devices and systems in this disclosure can be implemented as circuitry, firmware, software, functional instructions, other executable instructions, or any combination thereof. Some or all of the components may be combined as one component. A single component may be divided into sub-components, where each sub-component performs separate functions or steps of the single component.

For example, the functional components can be implemented in the form of special-purpose circuitry, in the form of one or more appropriately programmed processors, a single board chip, a field-programmable gate array (FPGA), a general-purpose computing device configured by executable instructions, a virtual machine configured by executable instructions, a cloud computing environment configured by executable instructions, or any combination thereof. For example, the functional components described can be implemented as instructions on a tangible storage memory capable of being executed by a processor or other integrated circuit chip. The tangible storage memory can be computer-readable data storage. The tangible storage memory may be volatile or non-volatile memory. In some embodiments, the volatile memory may be considered "non-transitory" in the sense that it is not a transitory signal. Memory space and storages described in the figures can be implemented as tangible storage memory as well, including volatile or non-volatile memory.

Each of the functional components may operate individually and independently of other functional components. Some or all of the functional components may be executed on the same host device or on separate devices. The separate devices can be coupled through one or more communication channels (e.g., wireless or wired channels) to coordinate their operations.

In some embodiments, at least some of the functional components share access to a memory space. For example, one functional component may access data accessed by or transformed by another functional component. The functional components may be considered "coupled" to one another if they share a physical connection or a virtual connection, directly or indirectly, allowing data accessed or modified by one functional component to be accessed in another functional component. In some embodiments, at least some of the functional components can be upgraded or modified remotely (e.g., by reconfiguring executable instructions that implements a portion of the functional components). Other arrays, systems and devices described above may include additional, fewer, or different functional components for various applications.

Figure 3:
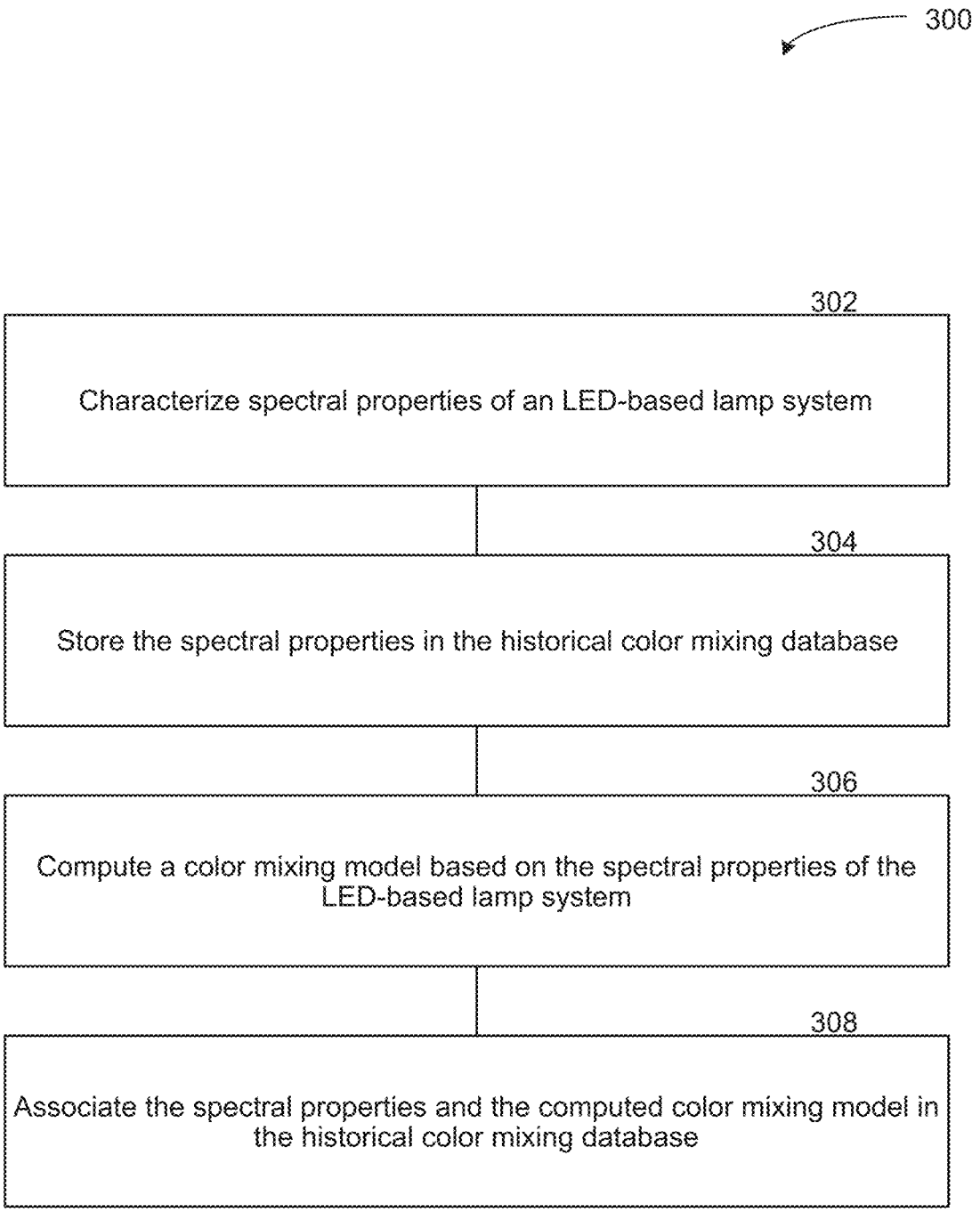
FIG. 3 is a flowchart illustrating a method of generating and updating a historical color mixing database, in accordance with various embodiments.

FIG. 3 is a flowchart illustrating a method 300 of generating and updating a historical color mixing database, in accordance with various embodiments. For example, the method 300 can be performed by a lamp provisioning computer system (e.g., that includes computing device 500 of FIG. 5). At step 302, the lamp provisioning computer system can characterize spectral properties (e.g., an overall composite SPD or SPDs of individual color channels) of an LED-based lamp system. For example, the spectral properties may be characterized as a spectral power distribution over a preset range of frequencies (e.g., the visible light frequency). At step 304, the lamp provisioning computer system can store the spectral properties in the historical color mixing database.

At step 306, the lamp provisioning computer system can compute a color mixing model based on the spectral properties of the LED-based lamp system. For example, the lamp provisioning computer system can compute the color mixing model using an inverse solver as disclosed in U.S. patent application Ser. No. 15/425,467.

At step 308, the lamp provisioning computer system can associate the spectral properties and the computed color mixing model in the historical color mixing database. For example, the historical color mixing database may be keyed and/or categorized by SPD profiles, each identified by an identification code. An SPD profile can be specified as different spectral power ranges in different spectral bands along the frequency axis. The lamp provisioning computer system can repeat this process (i.e., method 300) for multiple LED-based lamp systems until the historical color mixing database is populated with a threshold number of color mixing models. The threshold number of color mixing models can be specific to a particular type of LED-based lamp system. The threshold number of color mixing models can be specific to a "variance band" defined by the spectral properties of the LED-based lamp system. In some embodiments, the method 300 is repeated until a stable variance band is established.

Figure 6:
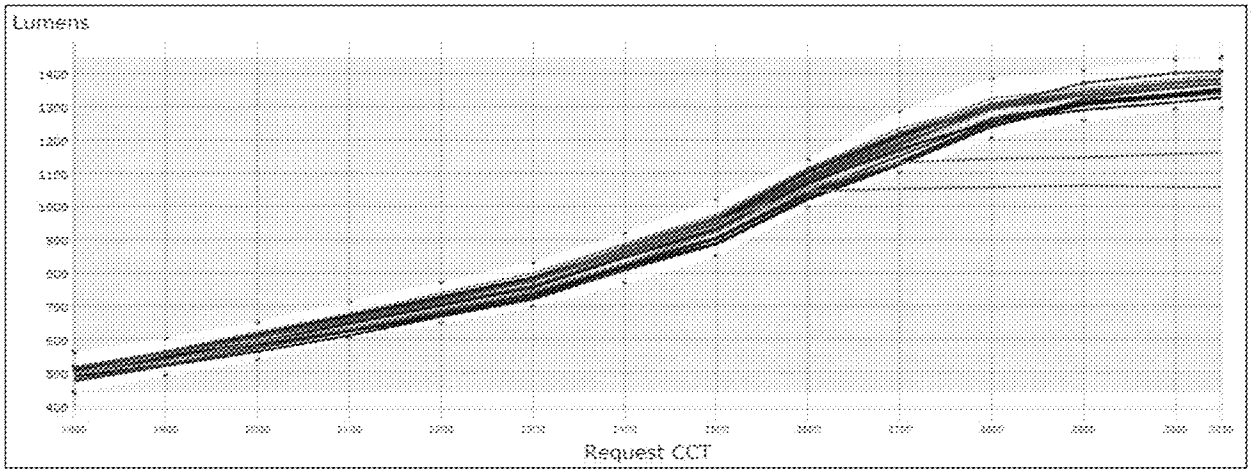
FIG. 6 is a graph chart plotting requested correlated color temperature (CCT) points in a color mixing model relative to lumens as a lamp performance metric.

In one example, the pass/fail specifications are built up of min/max "windows" on a per-measurement basis. For instance, at a given CCT, there is a minimum lumens level and a maximum lumens level that the light output must fall within in order to pass. There are multiple lamp performance metrics (e.g., up to 7, such as lumens in the example). For each CCT (40-ish CCT points measured), there is a min/max window for each of the lamp performance metrics (lumens, Ra, R9, power, Duv, efficacy, CCT error). A performance band (also referred to as a "variance band") would be the middle area on the graph where the measurements must lie. For example, in FIG. 6 the pink upper and lower areas are outside the acceptable specification, and lines showing measured results are in or out of range. FIG. 6 is a graph chart plotting requested CCT points in a color mixing model relative to lumens as a lamp performance metric.

Stability of the variance band can come from running more units with both the inverse solver method (referred to as the "long" method) and the matching method (referred to as the "quick" method), and fully measuring the results of both methods. Stability can be measured by running both the long and quick methods on the same LED based lamp systems, and then continuing to repeat the method 300 until the results of both methods identify similar or substantially the same color mixing models.

Figure 4:
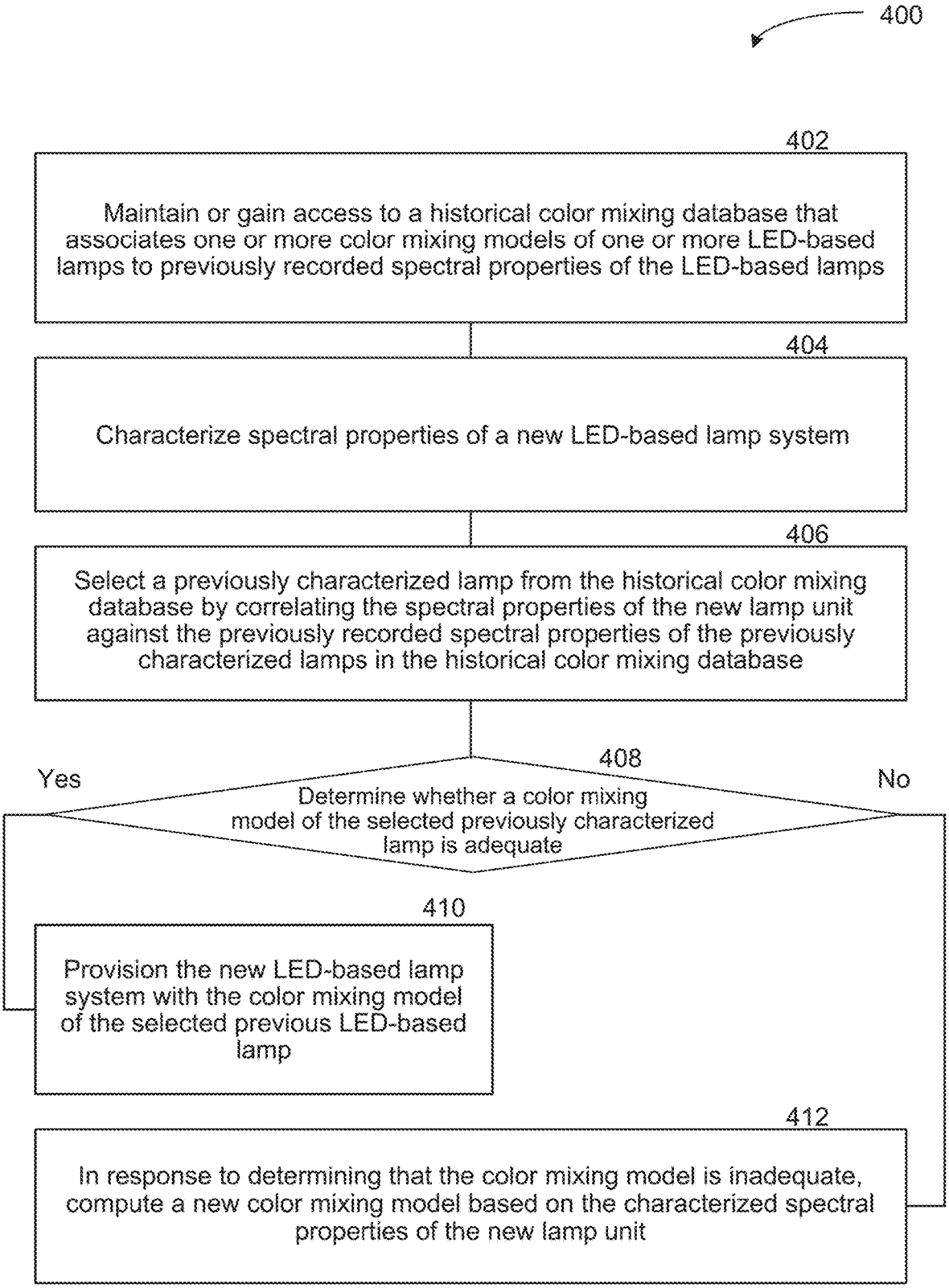
FIG. 4 is a flowchart illustrating a method of provisioning a color mixing model for a new LED-based lamp system, in accordance with various embodiments.

FIG. 4 is a flowchart illustrating a method 400 of provisioning a color mixing model for a new LED-based lamp system (e.g., LED-based lamp unit 200 of FIG. 2A or light mixing lamp system 250 of FIG. 2B), in accordance with various embodiments. For example, the method 400 can be performed by a lamp provisioning computer system (e.g., that includes computing device 500 of FIG. 5). At step 402, the lamp provisioning computer system can maintain or gain access to a historical color mixing database that associates one or more color mixing models of one or more LED-based lamps with previously-recorded spectral properties of the LED-based lamps.

At step 404, the lamp provisioning computer system can characterize spectral properties of a new LED-based lamp system. At step 406, the lamp provisioning computer system can select a previously-characterized lamp from the historical color mixing database by correlating/comparing the spectral properties of the new lamp unit against the previously-recorded spectral properties of the previously-characterized lamps in the historical color mixing database. In some embodiments, the historical color mixing database categorizes the previous lamp units into one or more lamp types (e.g., based on their SPD profiles). In those embodiments, the lamp provisioning computer system correlates/compares the spectral properties of the new LED-based lamp system against previously-recorded spectral properties of a subset of the previously-characterized lamps belonging to a lamp type of the new LED-based lamp system.

In some embodiments, at step 408, the lamp provisioning computer system determines whether a color mixing model of the selected previously-characterized lamp is adequate. Adequacy can be determined based on whether there are other color mixing models within a preset variance band of the spectral properties. In another example, adequacy is determined based on the number of color mixing models for the same lamp type or color channel types of the new LED-based lamp system. The lamp provisioning computer system can select a previously-characterized lamp system with the most similar spectral properties to the new LED-based lamp system.

In some embodiments, adequacy is monitored by determining how closely the input SPDs match their historical best match over time. For example, the difference between the input SPDs and the potential match can be measured by Euclidean distance or some other difference/comparison/distance function. As far as adequateness (i.e., "how close do they need to be"), the lamp provisioning system can find out by first searching history for the best match available, testing the historical unit's model (e.g., by measuring it), and then running the full known-good process and measuring its results. Over time, this process can reveal the details of how to decide whether the historical unit is "close enough" to the unit under test to trust that its model will yield passing results for the unit under test.

At step 410, the lamp provisioning computer system can provision the new LED-based lamp system with the color mixing model of the selected previously-characterized LED-based lamp. For example, the lamp provisioning computer system can provision the new lamp unit with the color mixing model of the selected previously-characterized lamp in response to determining that the color mixing model is adequate. "Provisioning" includes configuring the light mixing model as the default model to use when determining how to drive the color channels to produce light at a particular operating point in the color space.

In some embodiments, at step 412, the lamp provisioning computer system, in response to determining that the color mixing model is inadequate, computes a new color mixing model based on the characterized spectral properties of the new lamp unit. For example, the lamp provisioning computer system can utilize an inverse solver to generate the color mixing model. The inverse solver algorithm can determine corresponding operating parameters (e.g., the flux ratios of color channels) to produce various color space operating points utilizing the color channels of the new LED-based lamp system. The flux ratios of the color channels can be indicated as absolute flux ratios or color string driving parameters reflecting the absolute flux ratios.

The newly-computed color mixing model can be saved into the historical color mixing database. The lamp provisioning computer system can delay the appointment/upload of the newly-computed color mixing model to the historical color mixing database until the lamp provisioning computer system confirms statistically the accuracy of the color mixing model. For example, for future new LED-based lamp systems within the same variance band of the spectral properties of this new LED-based lamp system, the lamp provisioning computer system can compute the corresponding color mixing models from scratch (e.g., despite having a match to the color mixing model of this new LED-based lamp system). The higher the production volume of the color mixing models within this variance band, the more likely an adequate historical match would be available when provisioning even newer LED-based lamp systems. The quality/accuracy of these matches would also tend to improve with volume. In various embodiments, the method 400 enables the lamp provisioning computer system to avoid having to make the computation associated with generating a color mixing model most of the time without sacrificing quality of the color mixing model.

The lamp provisioning computer system can determine that there is a threshold error. The lamp provisioning computer system can continue to run both the quick historical match and the inverse solver process, fully measuring both results, until the quick historical match meets a product yield requirement relative to the result of the inverse solver process. For example, the product yield requirement may be a 99.7% yield. In such embodiments, we would want to see that out of 1000 or more units, the quick historical match process yielded 99.7% at least, and it is all fully confirmed by the full inverse solver process. The lamp provisioning computer system can confirm the quick historical match process after the yield threshold is met.

In some embodiments, after an initial confidence-gaining sample size (e.g., 1000 LED-based lamp systems) of fully inversely solved color mixing models, then the lamp provisioning computer system can perform the full inverse solver process for a fraction (e.g., 1/10) of the unprovisioned LED-based lamp systems (e.g., without a color mixing model representative of its LED color strings). In some embodiments, the fraction can decrease in steps as sample size increases.

In the disclosed methods, the lamp provisioning computer system can match individual color channel spectra against a historical color channel spectra of a measured lamp system. If a match is made, then the lamp provisioning computer need not compute a color mixing model from scratch using a full inverse solver process. However, if the color channel spectra do not match a historical case, then the lamp system in question is a candidate for the full inverse solver process. An input spectra or SPD can be a set of X,Y points, where X is wavelength and Y is power. One example matching algorithm could use Euclidean distance, thus treating the SPDs as normal vectors.

While processes or blocks are presented in a given order in the figures, alternative embodiments may perform routines having steps, or employ systems having blocks, in a different order, and some processes or blocks may be deleted, moved, added, subdivided, combined, and/or modified to provide alternative or sub-combinations. Each of these processes or blocks may be implemented in a variety of different ways. In addition, while processes or blocks are at times shown as being performed in series, these processes or blocks may instead be performed in parallel, or may be performed at different times. When a process or step is "based on" a value or a computation, the process or step should be interpreted as based at least on that value or that computation.

Figure 5:
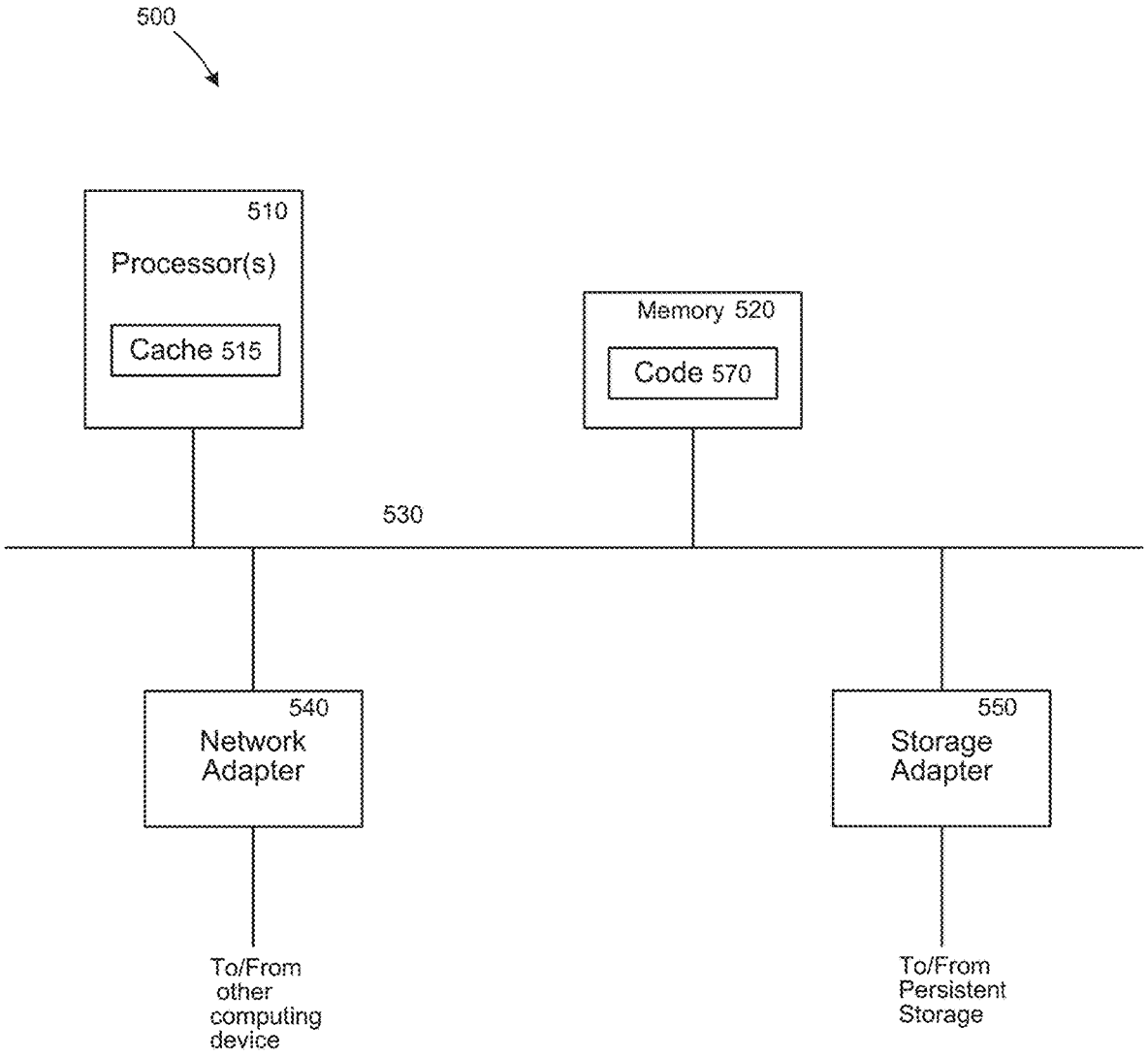
FIG. 5 is a block diagram of an example of a computing device, which may represent one or more computing device or server described herein, in accordance with various embodiments.

FIG. 5 is a block diagram of an example of a computing device 500, which may represent one or more computing device or server described herein, in accordance with various embodiments. The computing device 500 can be one or more computing devices that implement the model builder system 100. The computing device 500 includes one or more processors 510 and memory 520 coupled to an interconnect 530.

The processors 510 can represent different processor cores of a CPU. In some embodiments, the solver engine 150 can examine a single target color point (e.g., a color point of a reference lamp type for the color-tunable lamp to match) at a time. However, with multiple cores, each core can simultaneously examine a different target color point. The processors 510 can include a processor cache 515. The processor cache 515 and the processors 510 together enable the solver engine 150 to operate even faster. That is, the pre-compute tables produced by the solver engine 150 can be designed to fit in standard processor caches. Unlike conventional programs that cannot help but to dip in/out of memory or drive units, slowing execution many-fold, the solver engine 150 can light up the processors 510 and all the data necessary fit compactly within the processor cache 515 alone. When dealing with very "large" problem sets like this, it is unique to be able to do so (e.g., with little/no interaction with ram/network/drive).

The interconnect 530 shown in FIG. 5 is an abstraction that represents any one or more separate physical buses, point-to-point connections, or both connected by appropriate bridges, adapters, or controllers. The interconnect 530, therefore, may include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

The processor(s) 510 is/are the central processing unit (CPU) of the computing device 500, and thus control the overall operation of the computing device 500. In certain embodiments, the processor(s) 510 accomplish this by executing software or firmware stored in memory 520. The processor(s) 510 may be, or may include, one or more programmable general-purpose or special-purpose microprocessors, digital signal processors (DSPs), programmable controllers, application specific integrated circuits (ASICs), programmable logic devices (PLDs), trusted platform modules (TPMs), or the like, or a combination of such devices.

The memory 520 is or includes the main memory of the computing device 500. The memory 520 represents any form of random access memory (RAM), read-only memory (ROM), flash memory, or the like, or a combination of such devices. In use, the memory 520 may contain a code 570 containing instructions according to the mesh connection system disclosed herein.

Also connected to the processor(s) 510 through the interconnect 530 are a network adapter 540 and a storage adapter 550. The network adapter 540 provides the computing device 500 with the ability to communicate with remote devices over a network. Examples of network adapters 540 include an Ethernet adapter and Fibre Channel adapter. The network adapter 540 may also provide the computing device 500 with the ability to communicate with other computers. The storage adapter 550 enables the computing device 500 to access a persistent storage. Examples of storage adapters 550 include a Fibre Channel adapter and an SCSI adapter.

The code 570 stored in memory 520 may be implemented as software and/or firmware to program the processor(s) 510 to carry out actions described above. In certain embodiments, such software or firmware may be initially provided to the computing device 500 by downloading it from a remote system through the computing device 500 (e.g., via network adapter 540).

The techniques introduced herein can be implemented by, for example, programmable circuitry (e.g., one or more microprocessors) programmed with software and/or firmware, entirely in special-purpose hardwired circuitry, or in a combination of such forms. Special-purpose hardwired circuitry may be in the form of, for example, one or more application-specific integrated circuits (ASICs), programmable logic devices (PLDs), field-programmable gate arrays (FPGAs), etc.

Software or firmware for use in implementing the techniques introduced here may be stored on a machine-readable storage medium and may be executed by one or more general-purpose or special-purpose programmable microprocessors. A "machine-readable storage medium," as the term is used herein, includes any mechanism that can store information in a form accessible by a machine, such as a computer, network device, cellular phone, personal digital assistant (PDA), manufacturing tool, any device with one or more processors, etc. For example, a machine-accessible storage medium includes recordable/non-recordable media, such as read-only memory (ROM), random access memory (RAM), magnetic disk storage media, optical storage media, flash memory devices, etc.

The term "logic," as used herein, can include, for example, programmable circuitry programmed with specific software and/or firmware, special-purpose hardwired circuitry, or a combination thereof.

Some embodiments of the disclosure have other aspects, elements, features, and steps in addition to or in place of what is described above. These potential additions and replacements are described throughout the rest of the specification. Reference in this specification to "various embodiments," "several embodiments," or "some embodiments" means that a particular feature, structure, or characteristic described in connection with the embodiment is included in at least one embodiment of the disclosure. These embodiments, even alternative embodiments (which may be referenced as "other embodiments") are not mutually exclusive of other embodiments. Moreover, various features are described which may be exhibited by some embodiments and not by others. Similarly, various requirements are described which may be requirements for some embodiments but not other embodiments.

What is claimed is:

1. A light-emitting diode-based (LED-based) lamp system comprising:

multiple LED arrays comprising an LED array that includes multiple color strings, wherein each color string of the multiple color strings corresponds to a different color, and wherein each color string of the multiple color strings includes one or more LEDs having a substantially identical color;

a data storage memory system configured to store a historical color mixing database with multiple entries, wherein each entry of the multiple entries associates a characterized LED array with a previously-recorded spectral property and a corresponding color mixing model; and a controller configured to characterize a spectral property of the LED array, select, from the historical color mixing database, a color mixing model based on a comparison of the spectral property of the LED array to the previously-recorded spectral properties of the characterized LED arrays, and determine operating conditions for driving the multiple color strings of the LED array based on the selected color mixing model, wherein the controller is configured to update, in response to receiving an external command, the color mixing model corresponding to a particular LED array of the multiple LED arrays based on an optical sensor recording a light output by the particular LED array, and wherein the controller is configured to drive the multiple LED arrays utilizing multiple individual color mixing models corresponding to the multiple LED arrays, and is configured to generate a combined color mixing model based on the multiple individual color mixing models corresponding to the multiple LED arrays.

2. The LED-based lamp system of claim 1, wherein the data storage memory system includes multiple memory devices, and wherein each memory device of the multiple memory devices stores a color mixing model corresponding to a particular LED array of the multiple LED arrays.

3. The LED-based lamp system of claim 1, wherein the combined color mixing model is generated as a weighted average of the multiple individual color mixing models.

4. The LED-based lamp system of claim 1, wherein the controller is configured to communicate with a network-accessible computer server system to access the historical color mixing database, and wherein the historical color mixing database is accessible via a plurality of identification codes associated with the multiple LED arrays.

5. The LED-based lamp system of claim 1, wherein the controller is configured to retrieve an identification code associated with at least one LED array of the multiple LED arrays and query the historical color mixing database for a corresponding color mixing model associated with the at least one LED array.

6. The LED-based lamp system of claim 1, further comprising:

one or more photodiodes disposed in proximity to the multiple LED arrays, wherein the one or more photodiodes are configured to provide feedback to the controller for each color string of the multiple LED arrays in order to adjust the color mixing model.

7. The LED-based lamp system of claim 6, wherein the feedback includes a light intensity of a color string.

8. The LED-based lamp system of claim 6, wherein the feedback includes multiple light intensities corresponding to different bandwidth photodiodes of a color string, and wherein the controller is configured to detect color shift in the color string.

9. The LED-based lamp system of claim 6, wherein the data storage memory system is configured to store a reference color mixing model for a reference LED array of a preset LED array type, and wherein the controller is configured to adjust the reference color mixing model based on the feedback from the one or more photodiodes.

* * * * *